US009459558B1

(12) United States Patent
Onuki et al.

(10) Patent No.: US 9,459,558 B1
(45) Date of Patent: Oct. 4, 2016

(54) DEVELOPING DEVICE AND IMAGE FORMING APPARATUS

(71) Applicant: FUJI XEROX CO., LTD., Tokyo (JP)

(72) Inventors: Tomio Onuki, Kanagawa (JP); Masanori Kato, Kanagawa (JP); Yoshinori Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/873,442

(22) Filed: Oct. 2, 2015

(30) Foreign Application Priority Data

Apr. 20, 2015 (JP) ..... 2015-085647

(51) Int. Cl.
*G03G 15/08* (2006.01)

(52) U.S. Cl.
CPC ..... *G03G 15/0891* (2013.01)

(58) Field of Classification Search
CPC ..... G03G 15/0891
See application file for complete search history.

(56) References Cited

U.S. PATENT DOCUMENTS

2008/0181670 A1 7/2008 Tsuda et al.
2008/0187332 A1* 8/2008 Tsuda ..... G03G 15/0898 399/27
2012/0189349 A1* 7/2012 Okuno ..... G03G 15/0189 399/254

FOREIGN PATENT DOCUMENTS

JP 2005-091914 A 4/2005
JP 2006-293214 A 10/2006
JP 2012-177948 A 9/2012

* cited by examiner

*Primary Examiner* — G. M. Hyder
(74) *Attorney, Agent, or Firm* — Oliff PLC

(57) ABSTRACT

Provided is a developing device including a container that accommodates a developer, a developer holding member that develops the electrostatic latent image on the image holding member by delivering the developer to a position facing the image holding member, while rotating, a first transport member that extends in a direction of a rotary shaft of the developer holding member, and that transports the developer inside the container in a first direction, and a pushing-back member that pushes back the developer transported in the first direction by the first transport member in a direction opposite to the first direction, and that allows an amount of the developer beyond pushing-back capacity within the developer transported in the first direction, to exit from the container, wherein the container includes a control wall that controls passage of the developer.

18 Claims, 11 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2015-085647 filed Apr. 20, 2015.

BACKGROUND

Technical Field

An exemplary embodiment of the present invention relates to a developing device and an image forming apparatus.

SUMMARY

According to an aspect of the invention, there is provided a developing device including:

a container that accommodates a developer;

a developer holding member that is arranged so that a region close to an image holding member for holding an electrostatic latent image is exposed from the container, and that develops the electrostatic latent image on the image holding member by delivering the developer to a position facing the image holding member, while rotating;

a first transport member that extends in a direction of a rotary shaft of the developer holding member, and that transports the developer inside the container in a first direction; and a pushing-back member that is arranged ahead of the first transport member in the first direction, that pushes back the developer transported in the first direction by the first transport member in a direction opposite to the first direction, and that allows an amount of the developer beyond pushing-back capacity within the developer transported in the first direction, to exit from the container, wherein the container includes a control wall that controls passage of the developer by protruding from an inner wall surface forming a space through which the developer passes, in a shape extending in a direction intersecting the first direction, in the space.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described.

Figure 1:
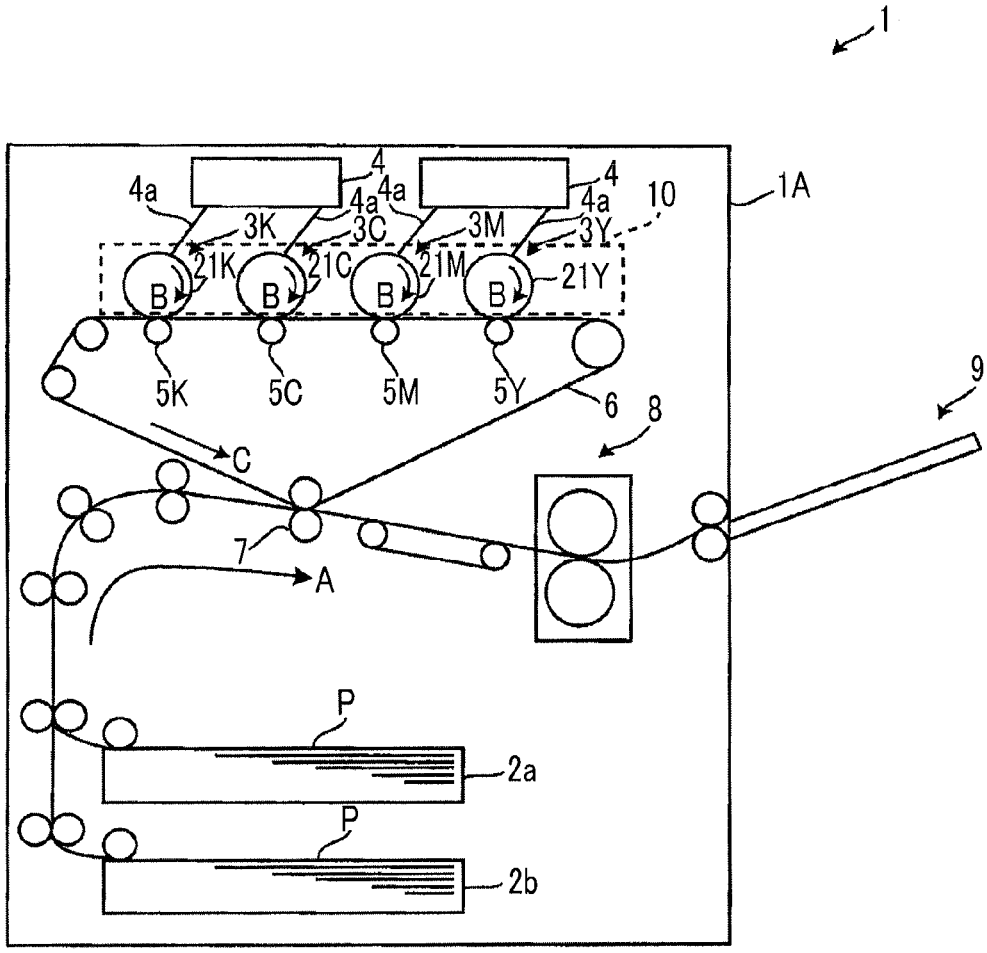
FIG. 1 is a schematic configuration diagram of a printer as an exemplary embodiment of an image forming apparatus according to an exemplary embodiment of the invention.

FIG. 1 is a schematic configuration diagram of a printer as an exemplary embodiment of an image forming apparatus according to the exemplary embodiment of the invention.

A printer 1 prints and outputs an image by using a so-called electrophotographic system.

Two sheet trays 2*a* and 2*b* are arranged in a lower part of the printer 1. The two sheet trays 2*a* and 2*b* are drawable, and sheets P are stacked and accommodated in the sheet trays 2*a* and 2*b*. The sheets P inside the sheet trays 2*a* and 2*b* are drawn out one by one for printing, and are transported through a transporting path illustrated by an arrow A.

Four image forming engines 3Y, 3M, 3C, and 3K are disposed in an upper part of the printer 1. The four image forming engines 3Y, 3M, 3C, and 3K respectively forma toner image using each color of yellow (Y), magenta (M), cyan (C), and black (K). Hereinafter, in the description common to the respective image forming engines 3Y, 3M, 3C, and 3K, the reference numerals of Y, M, C, and K which represent each color will be omitted, and the image forming engines 3Y, 3M, 3C, and 3K are simply referred to as image forming engines 3. In the drawings to be described later, the reference numerals of Y, M, C, and K which represent each color will also be omitted in some cases. The omission will be similarly applied to other configuration elements in addition to the image forming engines.

Each of the image forming engines 3 includes a photoreceptor 21 which rotates in a direction of an arrow B, a charger (not illustrated) which is arranged around the photoreceptor 21, a developing device, and a cleaner. The photoreceptor 21 is an example of an image holding member. An exposure device 4 is provided above the image forming engines 3. Image data is input to the printer 1 from a personal computer (not illustrated). The exposure device 4 exposes the photoreceptor 21 to exposure light 4*a* modulated in accordance with the image data.

Each photoreceptor 21 is charged by the charger, and an electrostatic latent image is formed by the exposure using the exposure device 4. The electrostatic latent image is developed by a toner accommodated in the developing device and a developer supplied from a carrier, thereby forming a toner image on the photoreceptor 21. Furthermore, the toner image is transferred by an operation of a primary transfer device 5 so as to be sequentially stacked on an intermediate transfer belt 6. The intermediate transfer belt 6 circularly moves in a direction of an arrow C. An operation of a secondary transfer device 7 transfers the toner image on the intermediate transfer belt 6 onto the sheet P transported to the corresponding position. The sheet P on which the toner image is transferred is further transported, is fixed by a fixing machine 8 using heat and pressure, and exits to an exit tray 9.

The four image forming engines 3 are incorporated in one drawable frame member 10, and have a structure in which the image forming engines 3 are accommodated so as to be integrally drawn out from a printer main body 1A.

Figure 2:
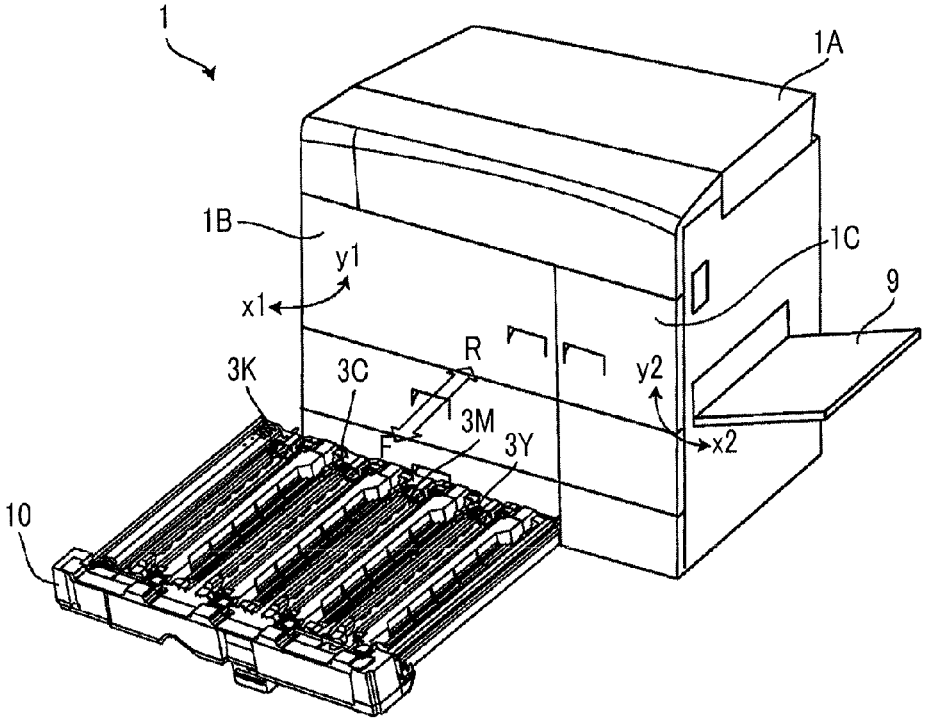
FIG. 2 is a perspective view illustrating a state where a frame member is drawn out from a printer main body.

FIG. 2 is a perspective view illustrating a state where the frame member is drawn out from the printer main body.

Doors 1B and 1C which opens and closes in each direction of arrows x1-y1 and x2-y2 are disposed on a front surface of the printer main body 1A. The frame member 10 is drawn out in a direction of an arrow F and is accommodated in a direction of an arrow R by opening the doors 1B and 10. As described above, the four image forming engines 3Y, 3M, 3C, and 3K are incorporated in the frame member 10.

Figure 3:
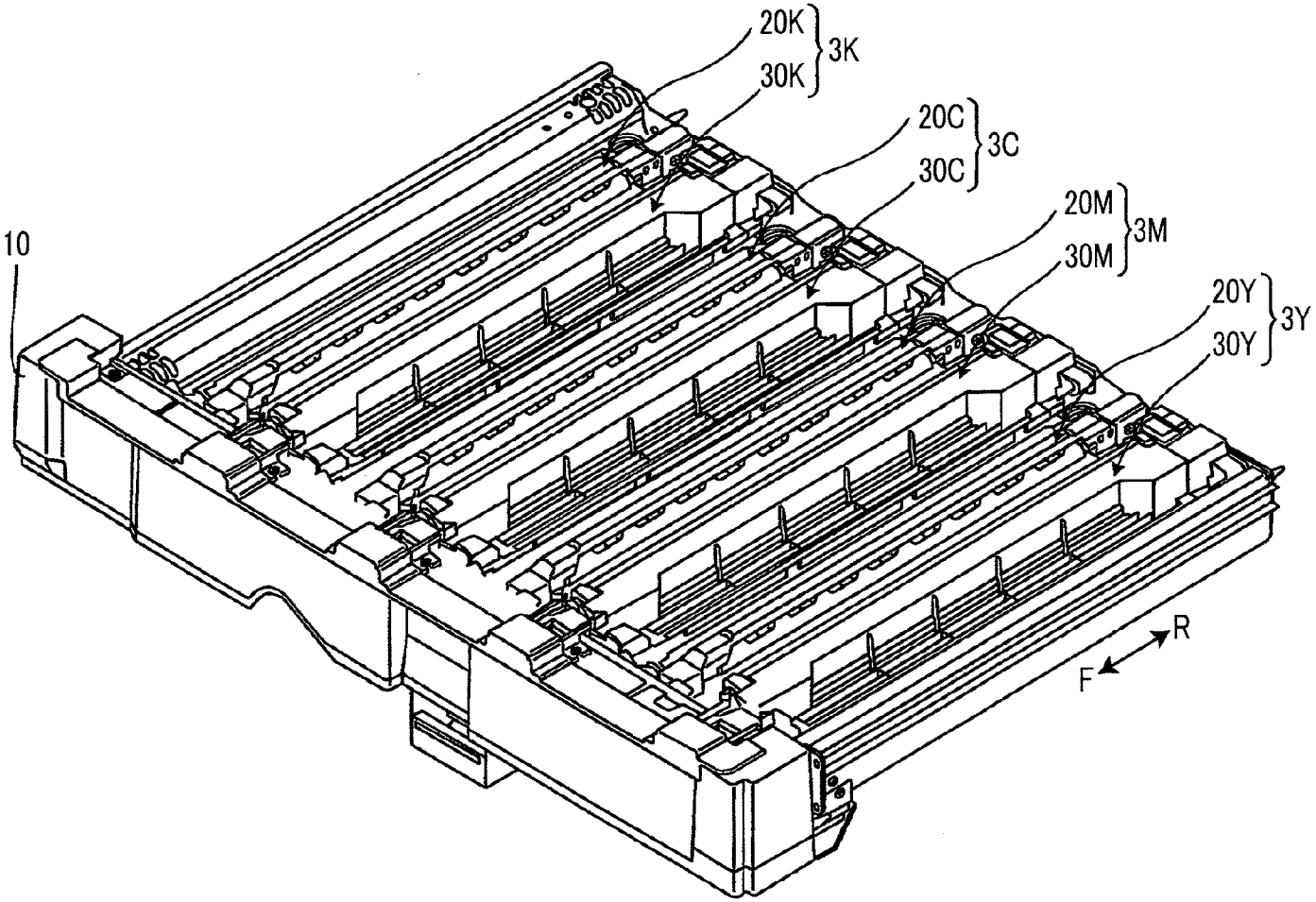
FIG. 3 is an external perspective view of the frame member on which four image forming engines are mounted.

FIG. 3 is an external perspective view of the frame member on which the four image forming engines are mounted.

The four image forming engines 3 are mounted on the frame member 10. The respective image forming engines 3 include a photoreceptor module 20 and a developing device module 30. In FIG. 3, a side indicated by the arrow F represents a front side, and a side indicated by the arrow R represents a rear side (refer to the arrows F-R in FIG. 2). In a case of the arrows F-R illustrated in FIG. 4 and the subsequent drawings to be described below, the side indicated by the arrow F also represents the front side, and the side indicated by the arrow R also represents the rear side.

Figure 4:
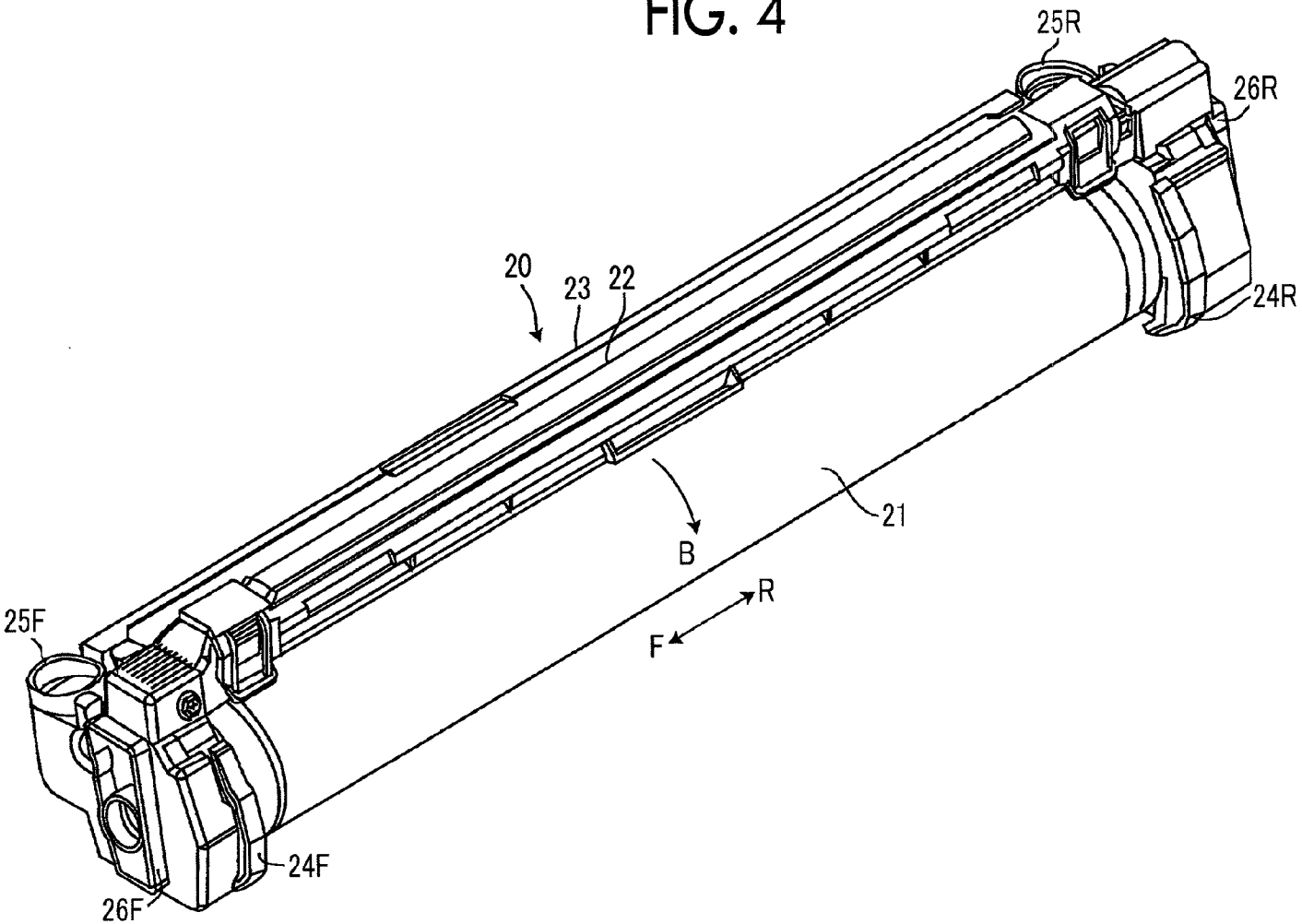
FIG. 4 is a perspective view of one photoreceptor module.

FIG. 4 is a perspective view of one photoreceptor module.

The photoreceptor 21, a charger 22, and a cleaner 23 are incorporated in the photoreceptor module 20. The photoreceptor 21 rotates in a direction of an arrow B (refer to FIG. 4 together with FIG. 1) in response to an operation of the printer 1 (refer to FIG. 1). The photoreceptor module 20 needs to be replaced since the photoreceptor 21 is worn while the printer 1 (refer to FIG. 1) is used for a long period of time, and has a structure which may be replaced by a user of the printer 1 (refer to FIG. 1).

Distance regulating members 24F and 24R are respectively disposed on both sides of the photoreceptor module 20 in a direction of a rotary shaft of the photoreceptor 21. The distance regulating members 24F and 24R regulates the photoreceptor 21 included in the photoreceptor module 20 and a developing roll 31 (refer to FIGS. 6 and 7) incorporated in the developing device module 30 so as to have a constant distance therebetween.

Ring-shaped knobs 25F and 25R are respectively disposed at both end upper portions in the photoreceptor module 20. The knobs 25F and 25R may be rotated into an upright state. A finger may be inserted into rings so as to lift the rings. In this manner, the photoreceptor module 20 may be pulled out upward from the frame member 10 illustrated in FIG. 3.

Guide portions 26F and 26R are respectively disposed on both end surfaces of the photoreceptor module 20. The guide portions 26F and 26R are guided so as to fit into a guide groove (not illustrated) disposed in the frame member 10, thereby allowing the photoreceptor module 20 to be mounted on the frame member 10.

Figure 5:
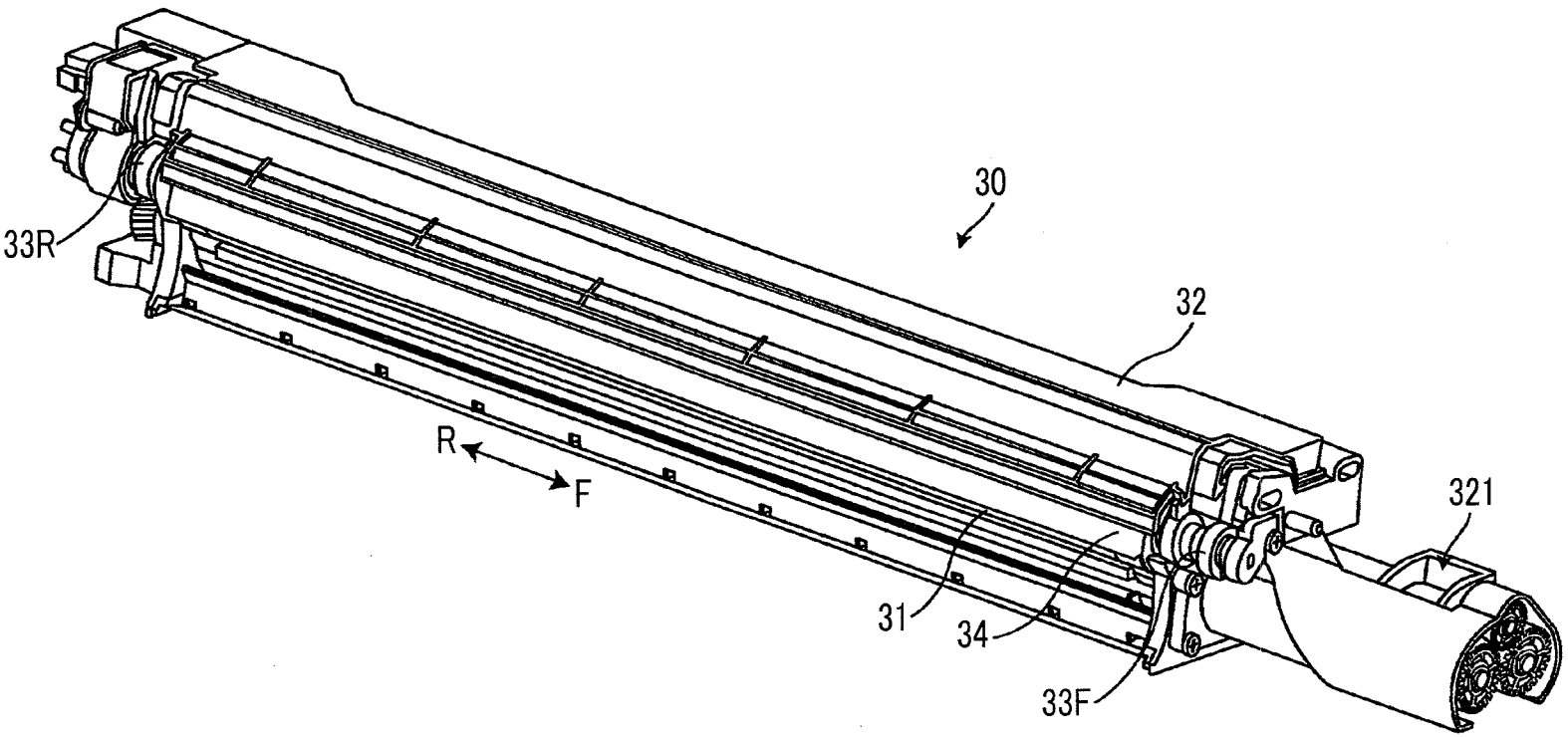
FIG. 5 is a perspective view of one developing device module.

FIG. 5 is a perspective view of one developing device module.

The developing device module 30 is fixed to the frame member 10 so as not to be easily replaced. The developing roll 31 is incorporated in the developing device module 30. The developing roll 31 is arranged so that a region close to the photoreceptor 21 incorporated in the photoreceptor module 20 in a state of being mounted on the frame member 10 is exposed from a container 32. The developing roll 31 rotates so that a portion facing the photoreceptor 21 moves forward in the same direction as the photoreceptor 21. In the developing device module 30, distance regulating rollers 33F and 33R which freely rotate coaxially with the developing roll 31 are respectively disposed on both sides of the developing roll 31. The distance regulating rollers 33F and 33R come into contact with the distance regulating members 24F and 24R (refer to FIG. 4) disposed in the photoreceptor module 20, thereby allowing a structure in which the photoreceptor 21 and the developing roll 31 always maintain a constant distance therebetween. The developing device module 30 corresponds to an example of a developing device, and the developing roll 31 corresponds to an example of a developer holding member.

A toner supply port 321 through which a toner is supplied from a toner bottle (not illustrated) is disposed in the container 32 of the developing device module 30. The toner supplied from the toner supply port 321 is delivered to a position close to the photoreceptor 21 by the developing roll 31, and an electrostatic latent image formed on the photoreceptor 21 is developed by the toner, thereby forming a toner image on the photoreceptor 21. A film-like sealing member 34 is disposed in the developing device module 30 so that the toner leaks out from a gap between the photoreceptor 21 and the developing roll 31.

Figure 6:
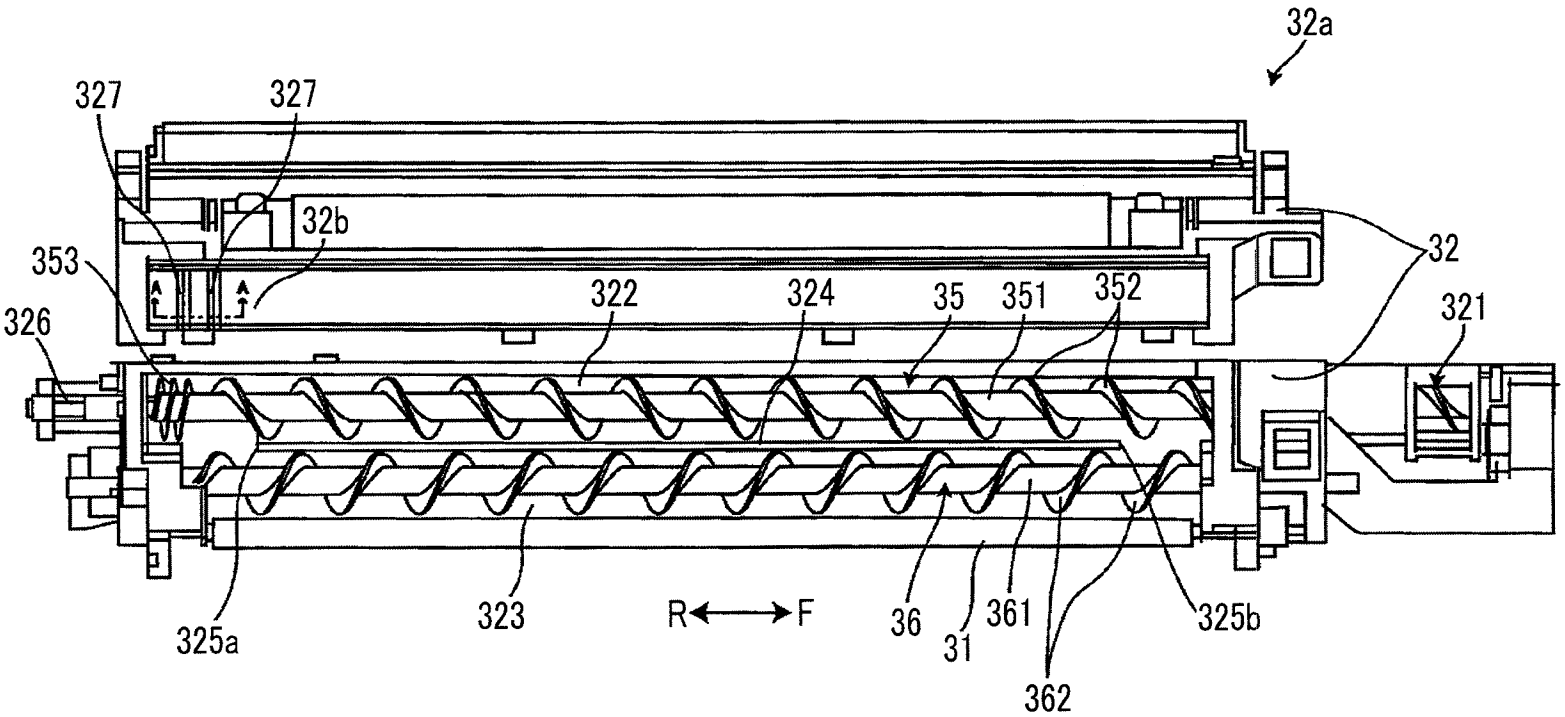
FIG. 6 is an exploded plan view of the developing device module.

FIG. 6 is an exploded plan view of the developing device module.

FIG. 6 illustrates an internal structure of the developing device module 30 by detaching an upper cover 32*a* which partially configures the container 32 of the developing device module 30. An inner surface of the upper cover 32*a* is also illustrated inside out. The upper cover 32*a* is aligned with a position located when the upper cover 32*a* is attached thereto in a longitudinal direction (direction of the arrows F-R).

The developing device module 30 includes a first auger 35 and a second auger 36 in addition to the developing roll 31 and the container 32 including the upper cover 32*a*.

A developer containing the toner supplied from the above-described toner supply port 321 is accommodated inside the container 32. The developer inside the container 32 is transported in the direction of the arrow R by the first auger 35, and is transported in the direction of the arrow F by the second auger 36.

The container 32 includes a first chamber 322 in which the first auger 35 is arranged and a second chamber 323 in which the second auger 36 is arranged. A partition wall 324 which partitions the first chamber 322 and the second chamber 323 is disposed in the container 32. The container 32 includes flow paths 325*a* and 325*b* for connecting the first chamber 322 and the second chamber 323 to each other in both end portions of the first auger 35 and the second auger 36. Therefore, the developer inside the first chamber 322 is transported in the direction of the arrow R by the first auger 35, and flows into the second chamber 323 from the flow path 325*a* on the left side in FIG. 6. The developer inside the second chamber 323 is transported in the direction of the arrow F by the second auger 36, and flows into the first chamber 322 from the flow path 325*b* on the right side in FIG. 6. In this way, the developer inside the container 32 is agitated while being circularly transported inside the container 32. Then, the developer agitated in this manner is delivered from the second chamber 323 to the developing roll 31, thereby developing an electrostatic latent image on the photoreceptor 21 (refer to FIGS. 1 and 4).

The first auger 35 includes a first spindle 351 which extends in the direction of the rotary shaft of the developing roll 31, and a first spiral vane 352 which is formed around the first spindle 351. The first auger 35 transports the developer inside the first chamber 322 in the direction of the arrow R by using the rotation of the first spindle 351.

The second auger 36 is arranged parallel to the first auger 35. Similarly to the first auger 35, the second auger 36 includes a second spindle 361 which extends in the direction of the rotary shaft of the developing roll 31, and a second spiral vane 362 which is formed around the second spindle 361. Compared to the first spiral vane 352, the second spiral vane 362 turns around the second spindle 361 in a direction opposite to that of the first spiral vane 352. However, a turning cycle of the second spiral vane 362 (pitch of the second spiral vane 362) is the same as a turning cycle of the first spiral vane 352 (pitch of the first spiral vane 352).

The second spindle 361 rotates in the same direction as the first spindle 351. Therefore, the developer inside the second chamber 323 is transported in the direction of the arrow F which is the direction opposite to that of the developer inside the first chamber 322 by the second spiral vane 362.

The first auger 35 further includes a third spiral vane 353 which is formed around the first spindle 351, ahead (left side in FIG. 6) of the first spiral vane 352 in a direction (direction illustrated by the arrow R) in which the developer is transported by the first spiral vane 352.

The third spiral vane 353 turns around the first spindle 351 at a smaller pitch, compared to the first spiral vane 351. The third spiral vane 353 turns around the first spindle 351 in a direction opposite to that of the first spiral vane 351 (that is, the same direction as the second spiral vane 362).

That is, within the developer transported into the first chamber 322 in the direction of the arrow R by the first spiral vane 352 after the first spindle 351 is rotated, the developer attempting to move straight without any change instead of flowing into the second chamber 323 through the flow path 325*a* is pushed back in the opposite direction (direction of the arrow F) by the third spiral vane 353. However, if the amount of the transported developer increases, the increased amount is beyond the pushing-back capacity of the third spiral vane 353. Consequently, the third spiral vane 353 cannot push back the total amounts. The developer partially moves straight without any change through a gap between the third spiral vane 353 and an inner wall surface of the container 32 in a portion accommodating the third spiral vane 353. The developer moving straight in this way exits outward from the container 32 through an exit port 326. The developer which has exited therethrough is accumulated in a waste toner tank (not illustrated) installed inside the printer 1 (refer to FIG. 1). The developing device module 30 adopts the above-described structure so that an excessive amount of the developer is not accommodated inside the container 32.

The first spindle 351 and the first spiral vane 352 which configure the first auger 35 correspond to an example of a first transport member, and the second spindle 361 and the second spiral vane 362 which configure the second auger 36 correspond to an example of a second transport member. The first spindle 351 and the third spiral vane 353 which configure the first auger 35 correspond to an example of a pushing-back member. That is, according to the exemplary embodiment, the first spindle 351 functions as a configuration element of both the first transport member and the pushing-back member.

Next, the upper cover 32*a* which configures the container 32 will be described. Two control walls 327 are formed on an inner wall surface 32*b* of a portion for covering an upper portion of the first auger 35 in the upper cover 32*a*.

Figure 7:
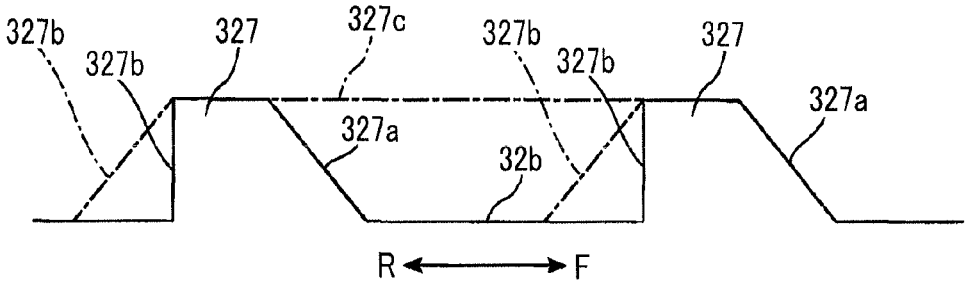
FIG. 7 is an enlarged sectional view which is taken along arrow A-A illustrated in FIG. 6, and which illustrates a sectional shape of a control wall.

FIG. 7 is an enlarged sectional view which is taken along arrow A-A illustrated in FIG. 6, and which illustrates a sectional shape of the control walls. In FIG. 7, the control walls 327 are illustrated by a solid line. A one-dot chain line is illustrated for subsequent description.

The control walls 327 are illustrated so as to be disposed in a direction protruding upward in accordance with the direction of the upper cover 32*a* illustrated in FIG. 6. However, in practice, the upper cover 32*a* is reversely attached thereto. Accordingly, the control walls 327 adopt a downward protruding posture. A portion where the control walls 327 is formed on the inner wall surface of the upper cover 32*a* has an arch shape in a sectional view. Accordingly, the control walls 327 also extend in the arc shape.

The control walls 327 protrude from the inner wall surface of the container 32, which forms a space in which the first auger 35 is arranged, in a shape of extending in a direction intersecting the direction (direction of the arrow R) in which the developer is transported by the first spiral vane 352, inside the space thereof.

Within the inner wall surface which forms the space in which the first auger 35 is arranged, the control walls 327 form a boundary region between both the first spiral vane 352 and the third spiral vane 353.

As illustrated in FIG. 7, the control walls 327 have a tilting surface which tilts to a downstream side in the transport direction (direction of the arrow R) of the developer, as a wall surface 327*a* on an upstream side in the direction (direction of the arrow R) in which the developer is transported by the first spiral vane 352 protrudes from the inner wall surface 32*b* of the container 32.

The control wall 327 is formed at multiple (two in the exemplary embodiment) locations by leaving a space therebetween in the transport direction (direction of the arrow R) of the developer.

An operation of the control walls 327 will be described later.

Figure 8:
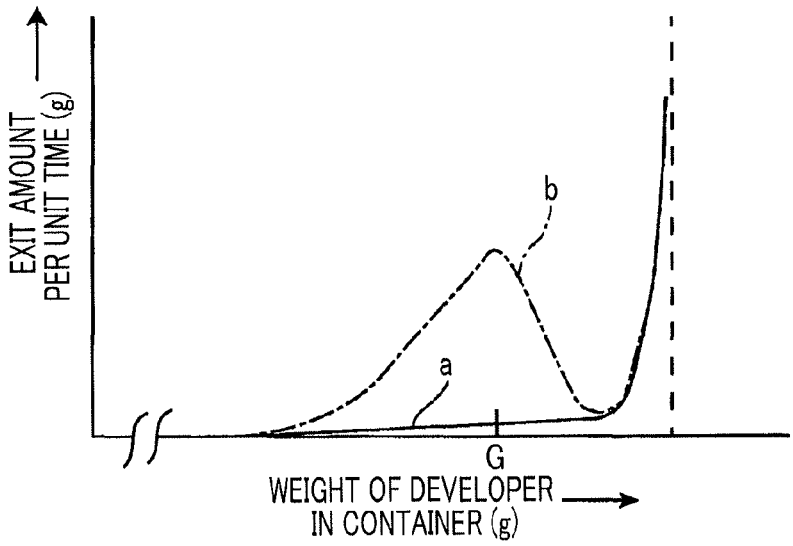
FIG. 8 is a graph for describing an operation of the control wall.

FIG. 8 is a graph for describing the operation of the control walls.

The horizontal axis in FIG. 8 represents a weight (g) of a developer inside a container. The vertical axis in the graph represents an exit amount of the developer per unit time from the exit port 326 (refer to FIG. 6).

FIG. 8 illustrates a graph a indicated by a solid line and a graph b indicated by a one-dot chain line.

In recent years, in order to increase the number of prints per unit time, the printer 1 (refer to FIG. 1) tends to be operated at fast speed. Without exception of the developing device module 30, not only the first auger 35 but also the second auger 36 is rotated at fast speed in response to a fast operation of the printer 1. Then, the developer is transported at fast speed. The following phenomenon occurs. Even if the amount itself of the developer to be transported by the first spiral vane 352 is the amount of the developer which the third spiral vane 353 is scheduled to push back, the developer exits from the exit port 326 without any change after slipping through the third spiral vane 353. According to scrutinized observation of the present inventors, it is found that the following phenomenon occurs. If the developer transported at fast speed by the first spiral vane 352 moves close to the third spiral vane 353, the developer scatters and rides over the third spiral vane 353 as if rushing waves have broken on the shore, for example.

The graph a in FIG. 8 represents an initially targeted exit amount. In contrast, the graph b in FIG. 8 represents an exit amount of a developer when the control walls 327 are not provided. If cases are observed from a case where the amount of the developer is small inside the container 32 to a case where the amount of the developer is large inside the container 32 (from the left side to the right side in FIG. 8), in a state where the amount of the developer increases to some extent, the exit amount increases, despite the fact that the amount of the developer does not yet reach the initially targeted exit amount. If the amount of the developer further increases, the excessive exit of the developer does not occur temporarily. The reason is that the amount of the developer increases in the container 32, a volume of a portion through which the developer passes becomes almost full, and thus there is no more extra space where the developer scatters as described above.

If the amount of the developer further increases inside the container 32, similarly to the graph a, the graph b also shows that the exit amount increases rapidly. This shows a normal exit amount which is expected. If the above-described control walls 327 are disposed on the inner wall surface 32*b* of the upper cover 32*a*, the graph b approximates to the graph a. Accordingly, the excessive exit as illustrated in the graph b is controlled.

As described above, the control walls 327 according to the exemplary embodiment are formed in the boundary region where both the first spiral vane 352 and the third spiral vane 353 are arranged, within the inner wall surface which forms the space in which the first auger 35 is arranged. The present inventors investigate whether the excessive exit of the developer may be effectively controlled if the control walls 327 are formed at any position in the longitudinal direction of the first auger 35. It is found that the best effect of controlling the excessive exit may be obtained if the control walls 327 are formed at the above-described position.

As illustrated in FIG. 7, the control walls 327 according to the exemplary embodiment have the tilting surface which tilts to the downstream side in the transport direction (direction of the arrow R) of the developer, as the wall surface 327*a* on the upstream side in the direction (direction of the arrow R) in which the developer is transported by the first spiral vane 352 protrudes from the inner wall surface 32*b* of the container 32.

If the wall surface 327*a* is formed into a vertical wall surface instead of the tilting surface, the exit amount of the developer increases. The reason is considered that air flowing together with developer and abutting against the wall surface causes turbulence to occur, and that the scattering of the developer cannot be controlled due to the turbulence. However, even in a case of the vertical wall surface, the excessive exit of the developer may be controlled, compared to a case where the control walls 327 are not provided.

According to the exemplary embodiment, the wall surface 327*a* is formed into the tilting surface. Therefore, the turbulence is less likely to occur, and the excessive exit of the developer may be more effectively controlled.

The wall surface 327*b* on the downstream side of the control walls 327 in the transport direction (direction of the arrow R) of the developer may employ the vertical wall surface as in the exemplary embodiment, or may be formed into the tilting surface like the wall surface 327*b* illustrated by the one-dot chain line in FIG. 7.

As described above, the control wall 327 is formed at the multiple (two in the exemplary embodiment) locations by leaving a space therebetween in the transport direction (direction of the arrow R) of the developer.

If a case where only one control wall 327 is formed therein is compared with a case where the multiple control walls 327 are formed therein, the better effect of controlling the excessive exit of the developer may be obtained in the case of the multiple control walls 327.

If a control wall which is long in the direction of the arrows F-R as illustrated by a one-dot chain line 327*c* in FIG. 7 is formed, the effect of controlling the excessive exit of the developer becomes worse, compared to a case where a short control wall is formed at multiple locations. The reason is considered that air delivered together with the developer flows adversely and thus causes turbulence to occur. However, even in this case, a considerably good effect may be obtained, compared to a case where no control wall is provided.

Figure 9:
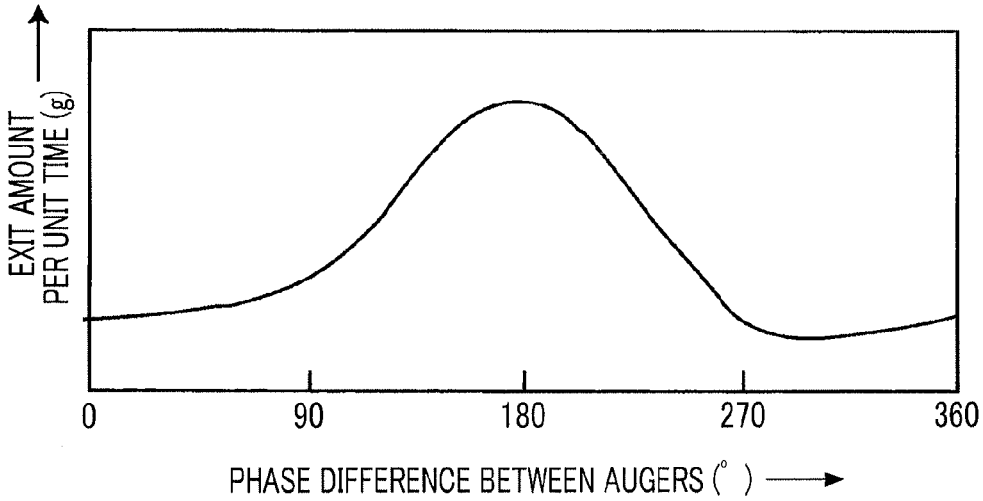
FIG. 9 is a graph illustrating another experiment example.

FIG. 9 is a graph illustrating another experiment example.

The horizontal axis in FIG. 9 represents a phase difference)(°) between the first auger 35 and the second auger 36. The vertical axis in FIG. 9 represents an exit amount of a developer per unit time. The amount of the developer inside the container 32 is aligned with a point G on the horizontal axis in FIG. 8.

Figure 10:
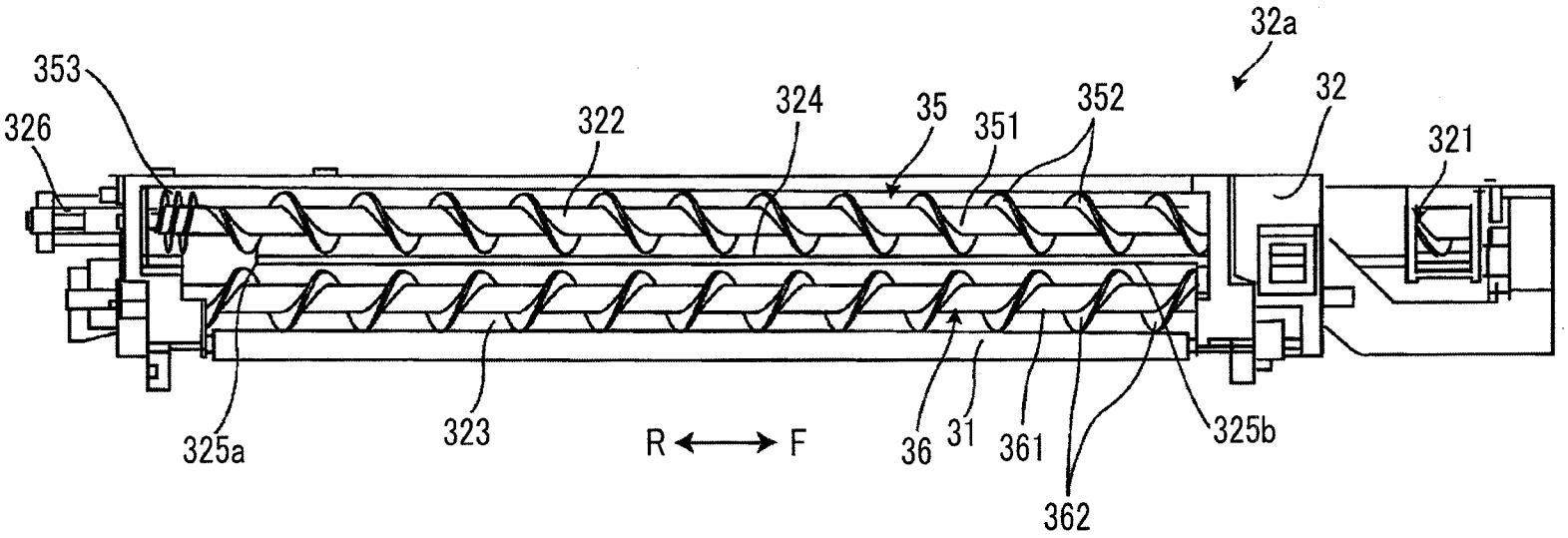
FIG. 10 is a view illustrating a state where respective phases of a first auger and a second auger are aligned with zero degree.

As illustrated in FIG. 9, due to the phase difference between the first auger 35 and the second auger 36, the exit amount of the developer varies greatly. Accordingly, a phase region having a large exit amount and a phase region having a small exit amount are present. FIG. 10 is a view illustrating a state where respective phases of the first auger 35 and the second auger 36 are aligned with zero degree.

Figure 11:
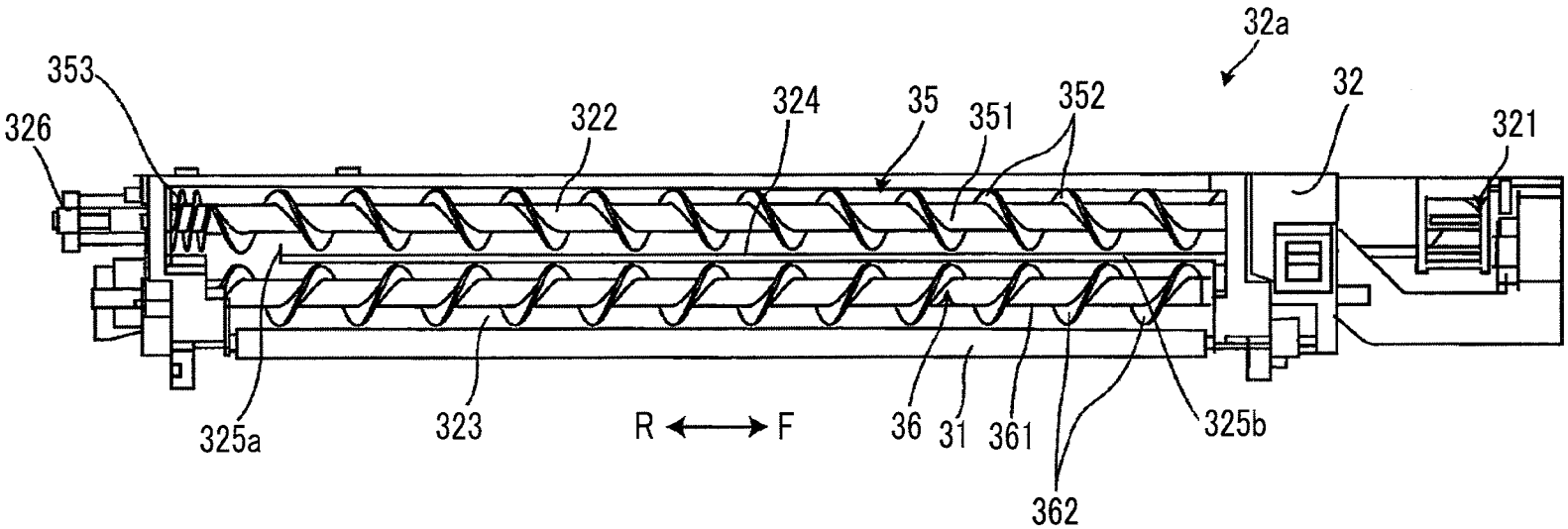
FIG. 11 is a view illustrating a state where the respective phases of the first auger and the second auger are misaligned with each other.

FIG. 11 is a view illustrating a state the respective phases of the first auger 35 and the second auger 36 are misaligned with each other.

As described above, the first spiral vane 352 which configures the first auger 35 transports the developer inside the first chamber 322 in the direction of the arrow R. Therefore, if the first spiral vane 352 is observed at a fixed point, it seems that the first spiral vane 352 moves in the direction of the arrow R. Similarly, the second spiral vane 362 which configures the second auger 36 transports the developer inside the second chamber 323 in the direction of the arrow F. Therefore, if the second spiral vane 362 is observed at a fixed point, it seems that the second spiral vane 362 moves in the direction of the arrow F.

An issue to be described herein is whether the first spiral vane 352 and the second spiral vane 362 are brought into a state where both of these are closest to each other at any position during the above-described movement.

In FIG. 10, the first spiral vane 352 and the second spiral vane 362 are brought into a state where both of these are closest to each other on the arrow F side within the flow path 325*a*. Here, the state is set to a phase difference 0°.

In FIG. 11, the first spiral vane 352 and the second spiral vane 362 are brought into a state where both of these are closest to each other in the vicinity of the center of the flow path 325*a* in the direction of the arrows F-R. That is, the state shows a state where phases of the first auger 35 and the second auger 36 are misaligned with each other.

According to the exemplary embodiment, the phase difference between the first auger 35 and the second auger 36 is adjusted to be approximately 0°. In the phases, both the first spiral vane 352 and the second spiral vane 362 simultaneously open a front surface of the flow path 325*a* on the third spiral vane 353 side.

Figure 12:
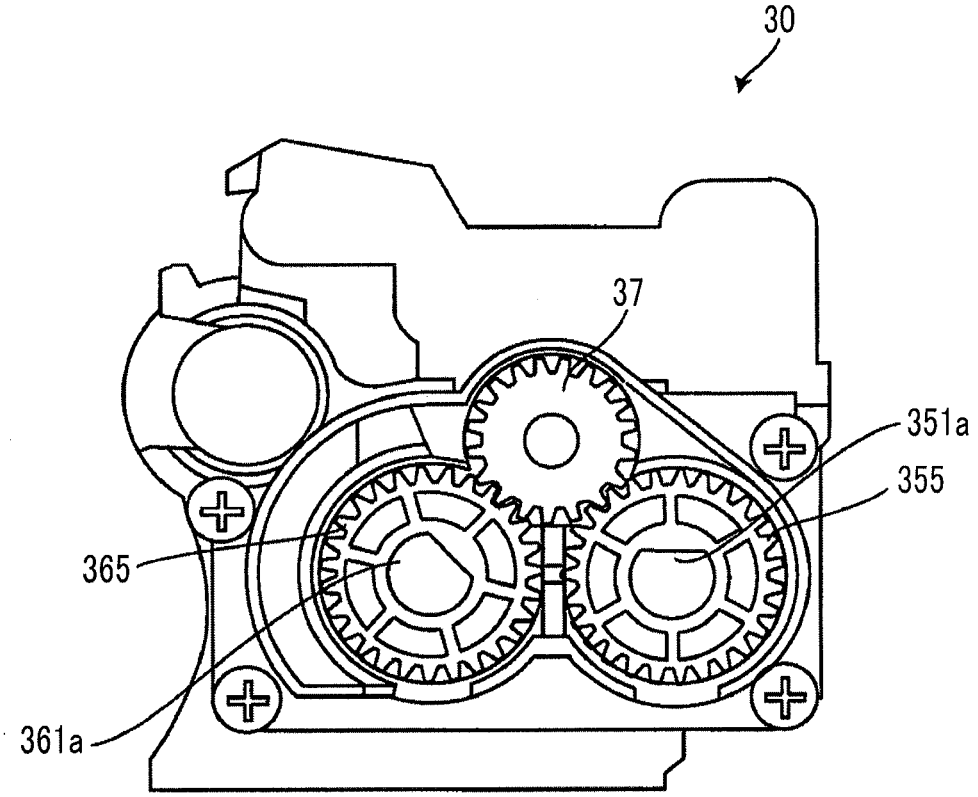
FIG. 12 is a side view of the developing device module.

FIG. 12 is a side view of the developing device module.

FIG. 12 illustrates a first gear 355 fixed to the first spindle 351 of the first auger 35, a second gear 365 fixed to the second spindle 361 of the second auger 36, and a driving gear 37 for transmitting a driving force to both the first gear 355 and the second gear 365. A joint portion 351*a* of the first spindle 351 of the first auger 35 with the first gear 355 is formed into a D-cut shape as illustrated. Similarly, a joint portion 361*a* of the second spindle 361 of the second auger 36 with the second gear 365 is also formed into a D-cut shape as illustrated. The D-cut direction of the joint portion 351*a* of the first spindle 351 and the phase of the first spiral vane 352 are determined uniquely. Similarly, the D-cut direction of the joint portion 361*a* of the second spindle 361 and the phase of the second spiral vane 362 are also determined uniquely. Therefore, when the developing device module 30 is assembled, the first gear 355, the second gear 365, and the driving gear 37 are assembled together by adjusting the D-cut direction of both the first spindle 351 and the second spindle 361. In this manner, the respective phases of the first auger 35 and the second auger 36 may be adjusted.

According to the exemplary embodiment, in addition to the control walls 327 disposed as described above, the respective phases of the first auger 35 and the second auger are adjusted as described above. Accordingly, the excessive exit of the developer as illustrated by the graph b in FIG. 8 is more effectively controlled.

Hitherto, an example has been described in which a so-called tandem machine printer includes four image forming engines 3. However, without being limited to the number of image forming engines, the exemplary embodiment of the invention may be applied to not only a monochrome machine including only one image forming engine, but also a printer including five or more image forming engines.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a container that accommodates a developer;

a developer holding member that is arranged so that a region close to an image holding member for holding an electrostatic latent image is exposed from the container, and that develops the electrostatic latent image on the image holding member by delivering the developer to a position facing the image holding member, while rotating;

a first transport member that extends in a direction of a rotary shaft of the developer holding member, and that transports the developer inside the container in a first direction; and a pushing-back member that is arranged ahead of the first transport member in the first direction, that pushes back the developer transported in the first direction by the first transport member in a direction opposite to the first direction, and that allows an amount of the developer beyond pushing-back capacity within the developer transported in the first direction, to exit from the container, wherein the container includes a control wall that controls passage of the developer by protruding from an inner wall surface forming a space through which the developer passes, in a shape extending in a direction intersecting the first direction, in the space, and the control wall adopts a downward protruding posture.

2. The developing device according to claim 1, wherein the control wall is formed in a boundary region where both the first transport member and the pushing-back member are arranged on an inner wall surface of the container.

3. The developing device according to claim 2, wherein a wall surface of the control wall which faces an upstream side in the first direction is a tilting surface that tilts to a downstream side in the first direction, in accordance with the wall surface protruding from the inner wall surface of the container.

4. The developing device according to claim 3, wherein the control wall is formed at a plurality of locations with a space therebetween in the first direction.

5. The developing device according to claim 4, wherein the first transport member includes a first spindle which extends in the direction of the rotary shaft and a first spiral vane which is formed around the first spindle, and transports the developer in the first direction by the first spiral vane using rotation of the first spindle, wherein the developing device further comprises a second transport member that is arranged parallel to the first transport member, that includes a second spindle which extends in the direction of the rotary shaft and a second spiral vane which is formed around the second spindle and which is spirally formed on a same cycle as the first spiral vane, and that transports the developer in a second direction opposite to the first direction by the second spiral vane using rotation of the second spindle, wherein the container includes a partition wall that partitions a first chamber in which the first transport member is arranged and a second chamber in which the second transport member is arranged, and a developer flow path that connects the first chamber and the second chamber which are respectively formed in both end portions of the first transport member and the second transport member, and wherein the first transport member and the second transport member are arranged in a phase when both the first spiral vane and the second spiral vane simultaneously open a front surface of the flow path on a pushing-back member side within the flow path.

6. The developing device according to claim 3, wherein the first transport member includes a first spindle which extends in the direction of the rotary shaft and a first spiral vane which is formed around the first spindle, and transports the developer in the first direction by the first spiral vane using rotation of the first spindle, wherein the developing device further comprises a second transport member that is arranged parallel to the first transport member, that includes a second spindle which extends in the direction of the rotary shaft and a second spiral vane which is formed around the second spindle and which is spirally formed on a same cycle as the first spiral vane, and that transports the developer in a second direction opposite to the first direction by the second spiral vane using rotation of the second spindle, wherein the container includes a partition wall that partitions a first chamber in which the first transport member is arranged and a second chamber in which the second transport member is arranged, and a developer flow path that connects the first chamber and the second chamber which are respectively formed in both end portions of the first transport member and the second transport member, and wherein the first transport member and the second transport member are arranged in a phase when both the first spiral vane and the second spiral vane simultaneously open a front surface of the flow path on a pushing-back member side within the flow path.

7. The developing device according to claim 2, wherein the control wall is formed at a plurality of locations with a space therebetween in the first direction.

8. The developing device according to claim 7, wherein the first transport member includes a first spindle which extends in the direction of the rotary shaft and a first spiral vane which is formed around the first spindle, and transports the developer in the first direction by the first spiral vane using rotation of the first spindle, wherein the developing device further comprises a second transport member that is arranged parallel to the first transport member, that includes a second spindle which extends in the direction of the rotary shaft and a second spiral vane which is formed around the second spindle and which is spirally formed on a same cycle as the first spiral vane, and that transports the developer in a second direction opposite to the first direction by the second spiral vane using rotation of the second spindle, wherein the container includes a partition wall that partitions a first chamber in which the first transport member is arranged and a second chamber in which the second transport member is arranged, and a developer flow path that connects the first chamber and the second chamber which are respectively formed in both end portions of the first transport member and the second transport member, and wherein the first transport member and the second transport member are arranged in a phase when both the first spiral vane and the second spiral vane simultaneously open a front surface of the flow path on a pushing-back member side within the flow path.

9. The developing device according to claim 2, wherein the first transport member includes a first spindle which extends in the direction of the rotary shaft and a first spiral vane which is formed around the first spindle, and transports the developer in the first direction by the first spiral vane using rotation of the first spindle, wherein the developing device further comprises a second transport member that is arranged parallel to the first transport member, that includes a second spindle which extends in the direction of the rotary shaft and a second spiral vane which is formed around the second spindle and which is spirally formed on a same cycle as the first spiral vane, and that transports the developer in a second direction opposite to the first direction by the second spiral vane using rotation of the second spindle, wherein the container includes a partition wall that partitions a first chamber in which the first transport member is arranged and a second chamber in which the second transport member is arranged, and a developer flow path that connects the first chamber and the second chamber which are respectively formed in both end portions of the first transport member and the second transport member, and wherein the first transport member and the second transport member are arranged in a phase when both the first spiral vane and the second spiral vane simultaneously open a front surface of the flow path on a pushing-back member side within the flow path.

10. The developing device according to claim 1, wherein a wall surface of the control wall which faces an upstream side in the first direction is a tilting surface that tilts to a downstream side in the first direction, in accordance with the wall surface protruding from the inner wall surface of the container.

11. The developing device according to claim 10, wherein the control wall is formed at a plurality of locations with a space therebetween in the first direction.

12. The developing device according to claim 11, wherein the first transport member includes a first spindle which extends in the direction of the rotary shaft and a first spiral vane which is formed around the first spindle, and transports the developer in the first direction by the first spiral vane using rotation of the first spindle, wherein the developing device further comprises a second transport member that is arranged parallel to the first transport member, that includes a second spindle which extends in the direction of the rotary shaft and a second spiral vane which is formed around the second spindle and which is spirally formed on a same cycle as the first spiral vane, and that transports the developer in a second direction opposite to the first direction by the second spiral vane using rotation of the second spindle, wherein the container includes a partition wall that partitions a first chamber in which the first transport member is arranged and a second chamber in which the second transport member is arranged, and a developer flow path that connects the first chamber and the second chamber which are respectively formed in both end portions of the first transport member and the second transport member, and wherein the first transport member and the second transport member are arranged in a phase when both the first spiral vane and the second spiral vane simultaneously open a front surface of the flow path on a pushing-back member side within the flow path.

13. The developing device according to claim 10, wherein the first transport member includes a first spindle which extends in the direction of the rotary shaft and a first spiral vane which is formed around the first spindle, and transports the developer in the first direction by the first spiral vane using rotation of the first spindle, wherein the developing device further comprises a second transport member that is arranged parallel to the first transport member, that includes a second spindle which extends in the direction of the rotary shaft and a second spiral vane which is formed around the second spindle and which is spirally formed on a same cycle as the first spiral vane, and that transports the developer in a second direction opposite to the first direction by the second spiral vane using rotation of the second spindle, wherein the container includes a partition wall that partitions a first chamber in which the first transport member is arranged and a second chamber in which the second transport member is arranged, and a developer flow path that connects the first chamber and the second chamber which are respectively formed in both end portions of the first transport member and the second transport member, and wherein the first transport member and the second transport member are arranged in a phase when both the first spiral vane and the second spiral vane simultaneously open a front surface of the flow path on a pushing-back member side within the flow path.

14. The developing device according to claim 1, wherein the control wall is formed at a plurality of locations with a space therebetween in the first direction.

15. The developing device according to claim 14, wherein the first transport member includes a first spindle which extends in the direction of the rotary shaft and a first spiral vane which is formed around the first spindle, and transports the developer in the first direction by the first spiral vane using rotation of the first spindle, wherein the developing device further comprises a second transport member that is arranged parallel to the first transport member, that includes a second spindle which extends in the direction of the rotary shaft and a second spiral vane which is formed around the second spindle and which is spirally formed on a same cycle as the first spiral vane, and that transports the developer in a second direction opposite to the first direction by the second spiral vane using rotation of the second spindle, wherein the container includes a partition wall that partitions a first chamber in which the first transport member is arranged and a second chamber in which the second transport member is arranged, and a developer flow path that connects the first chamber and the second chamber which are respectively formed in both end portions of the first transport member and the second transport member, and wherein the first transport member and the second transport member are arranged in a phase when both the first spiral vane and the second spiral vane simultaneously open a front surface of the flow path on a pushing-back member side within the flow path.

16. The developing device according to claim 1, wherein the first transport member includes a first spindle which extends in the direction of the rotary shaft and a first spiral vane which is formed around the first spindle, and transports the developer in the first direction by the first spiral vane using rotation of the first spindle, wherein the developing device further comprises a second transport member that is arranged parallel to the first transport member, that includes a second spindle which extends in the direction of the rotary shaft and a second spiral vane which is formed around the second spindle and which is spirally formed on a same cycle as the first spiral vane, and that transports the developer in a second direction opposite to the first direction by the second spiral vane using rotation of the second spindle, wherein the container includes a partition wall that partitions a first chamber in which the first transport member is arranged and a second chamber in which the second transport member is arranged, and a developer flow path that connects the first chamber and the second chamber which are respectively formed in both end portions of the first transport member and the second transport member, and wherein the first transport member and the second transport member are arranged in a phase when both the first spiral vane and the second spiral vane simultaneously open a front surface of the flow path on a pushing-back member side within the flow path.

17. An image forming apparatus comprising:

an image holding member that holds an electrostatic latent image formed thereon, while rotating; and the developing device according to claim 1.

18. The developing device according to claim 1, wherein the control walls extend in an arc shape.

* * * * *